United States Patent [19]

Fel

[11] Patent Number: 4,897,935

[45] Date of Patent: Feb. 6, 1990

[54] NON-SLIP MEANS AND THEIR USES ON SHOE SOLES

[76] Inventor: Jean-Louis Fel, 26 rue de Comblat - Belbex, 15000 Aurillac, France

[21] Appl. No.: 133,047

[22] PCT Filed: Mar. 18, 1987

[86] PCT No.: PCT/FR87/00077

§ 371 Date: Jan. 4, 1988

§ 102(e) Date: Jan. 4, 1988

[87] PCT Pub. No.: WO87/05475

PCT Pub. Date: Sep. 24, 1987

[30] Foreign Application Priority Data

Aug. 19, 1986 [FR] France ..... 86 04306
Sep. 18, 1986 [FR] France ..... 86 13302

[51] Int. Cl.[4] ..... A43B 3/18

[52] U.S. Cl. ..... 36/7.7; 36/7.5; 36/7.6

[58] Field of Search ..... 36/7.1 R, 7.2, 7.3, 36/7.4, 7.5, 7.6, 7.7, 30 R, 59 R, 8.1; 15/227

[56] References Cited

U.S. PATENT DOCUMENTS

| | | | |
|---|---|---|---|
| 1,315,482 | 9/1919 | Dyer | 36/7.6 |
| 1,851,778 | 3/1932 | Skillen | 36/7.5 |
| 2,260,037 | 10/1941 | Lazarus | 36/7.6 |
| 2,268,435 | 12/1941 | Zucker | 36/7.5 |
| 2,547,812 | 4/1951 | Carabatsos | 36/7.6 |
| 2,685,141 | 8/1954 | Davenport | 36/7.6 |
| 2,720,714 | 10/1955 | Krohn | 36/7.5 |
| 2,932,910 | 4/1960 | Brown | 36/7.6 |
| 3,584,402 | 6/1971 | Silverman | 36/7.5 |
| 3,699,672 | 10/1972 | Sims | 36/7.7 |
| 4,251,932 | 2/1981 | Love | 36/7.7 |
| 4,674,205 | 6/1987 | Anger | 36/30 R |

FOREIGN PATENT DOCUMENTS

| | | | |
|---|---|---|---|
| 1766434 | 7/1971 | Fed. Rep. of Germany . | |
| 8222514 | 12/1982 | Fed. Rep. of Germany . | |
| 1033312 | 4/1953 | France . | |
| 2072486 | 10/1981 | United Kingdom | 36/30 R |

*Primary Examiner*—Werner H. Schroeder
*Assistant Examiner*—Diana L. Biefeld
*Attorney, Agent, or Firm*—Curtis, Morris & Safford

[57] ABSTRACT

A non-slip device which is fastened to a shoe by means of one or more straps. The device includes a backing pad and a non-slip surface carried by the pad which is composed of at least one layer of open cell elastic cellular material having a low density.

9 Claims, 4 Drawing Sheets

Figure 1:
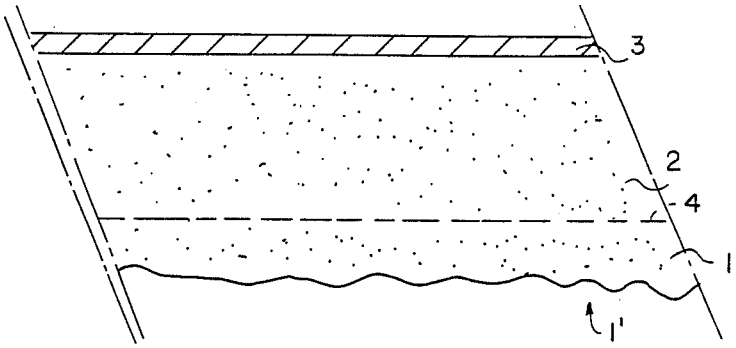

FIG. 8
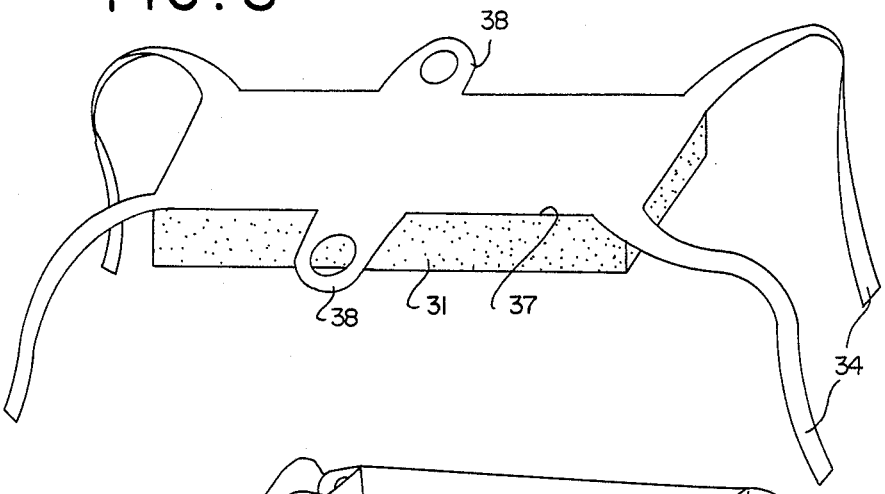
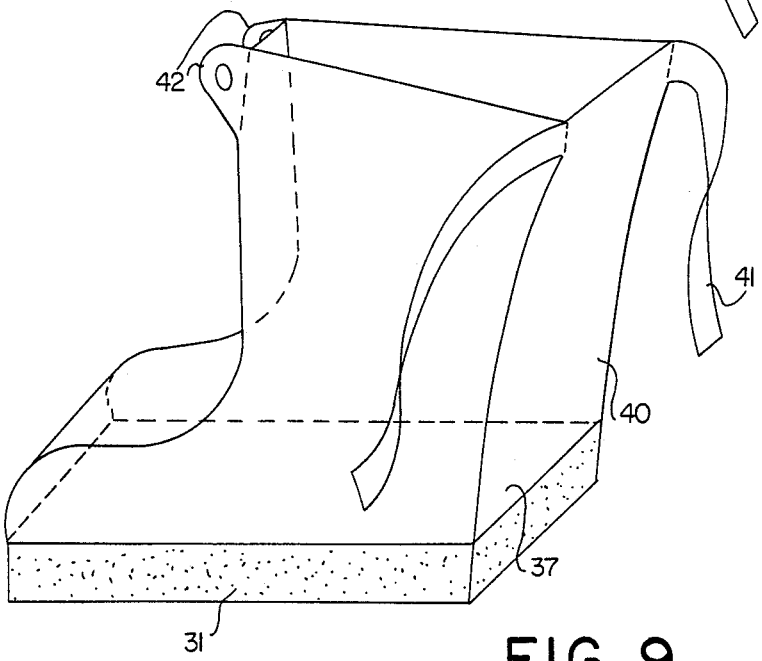
FIG. 9

NON-SLIP MEANS AND THEIR USES ON SHOE SOLES

The present invention is concerned with the safety of persons at risk of sliding on sloping and/or slippery ground and it relates to a general non-slip means and to its use on soles, pads or non-slip snowshoes.

According to the present invention, a non-slip device fastenable to a shoe by means of straps, the said device comprising essentially a non-slip surface integral with a pad, is defined in general terms in that the non-slip surface is composed of at least one layer of elastic cellular material with open cells and of low density.

Advantageously, the said elastic cellular material will be from the group comprising natural rubber foams, synthetic rubber foams and polyurethane, polyether and polyester foams; by a low density is meant a density comprised within the range of 30 to 40 kg/m$^3$.

The surface of this layer of material which shall be in contact with the ground shall have been cut in such a way that the orifices of the cells are opposite that on which the device will be used; for example, an outer skin of this layer, usually present when the foam is formed, would do away with the non-slip property; the lower so-called contact layer shall therefore have a spongy structure.

According to a particular embodiment, the non-slip or contact surface is laid against a second layer of cellular material of high elasticity, located between the lower face of the pad and the so-called first layer of material with open cells.

Advantageously, at least one sheet of stretchable cloth, such as nylon fabric, is bonded between the two foam layers, the adhesion of the said sheet at least being greater on the second layer than on the first, as a result of which the cloth sheet both prevents the tearing of the foam layers and allows the first layer to be exchanged.

The above-defined arrangements being applied to a pad of the type in which the non-slip surface is fastened to a rigid pad itself fastenable to the shoe, the pad has a rigid shell shape comprising a recess in the form of the imprint of a shoe; preferably, the pad is fastened to the shoe by means of a pair of components called plates, having an axle through-hole and two elongate slots substantially in the extension of one another and oriented at approximately 130° relative to one another, the axle hole being contained in the angle of the slots and intended for the passage of a screw screwable into inserts arranged in the fore part of the wall of the said imprint and on each side of the latter; also preferably, the location of each plate is defined by a recessed chamber in the wall of the imprint; preferably yet again, the imprint opens onto the outside of the shell in its rear part, the opening being spanned by a bar functioning as a handle.

According to an advantageous embodiment of the strapping, the said strap is a continuous strap, the length of which is such that it allows it to pass over the shoe four times from one side of the foot to the other, passing through each of the slots in the buckles, and behind the heel twice, two buckles respectively ensuring the closing of the strap on itself and its guidance.

According to another embodiment or manner of use of the invention, a non-slip device in the form of a flexible sole fastenable to the shoe is defined, in general terms, in that it is composed of at least one "foam" panel and of means of fastening to a shoe which are integral with the said panel; the said fastening means preferably consist of ties, and the said ties are fixed to the said panel by means of a woven cloth of the gauze type.

According to a more particular embodiment, a sole of the invention incorporates the following elements stacked in succession: a first foam panel, a projecting pair of ties forming loops, each located towards the middle of the sides of the device, the gauze and a second foam layer; the stacked elements can be joined together by sewing as well as by adhesive bonding.

According to other embodiments, the fastening means can consist of self-gripping elements of the type marketed under the trademark of VELCRO, some of these elements being fastened to the upper face of the device, and other opposing elements intended to be bonded to the shoe, or can consist of a thin plastic sheet cut according to the shape of the ties and loops mentioned above,, or consist of adhesive elements.

According to another embodiment, the fastening means consist of an "overboot" which is made of thin plastic and the foam panel of which forms the sole.

Figure 2:
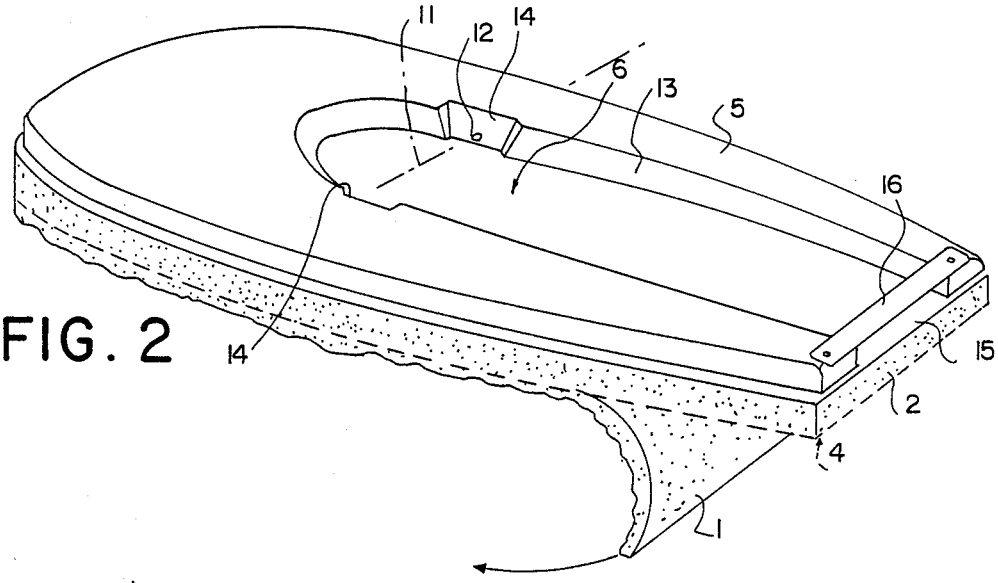
Figure 3A:
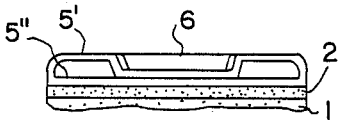
Figure 3B:
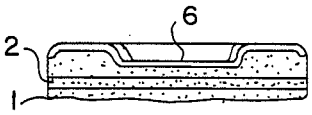
Figure 5:
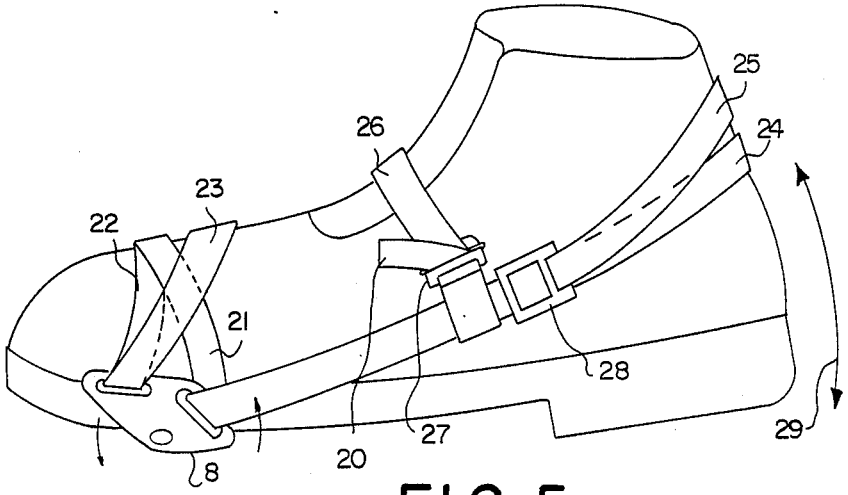
Figure 4:
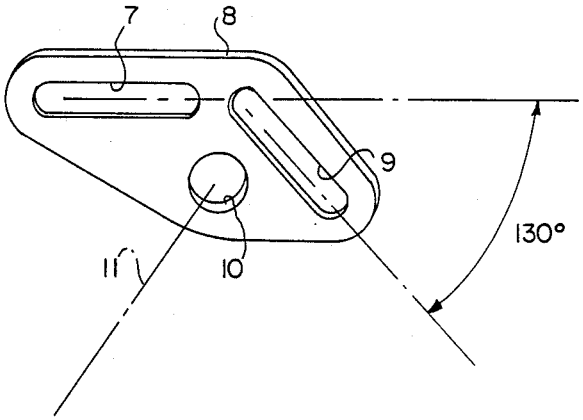
Figure 6:
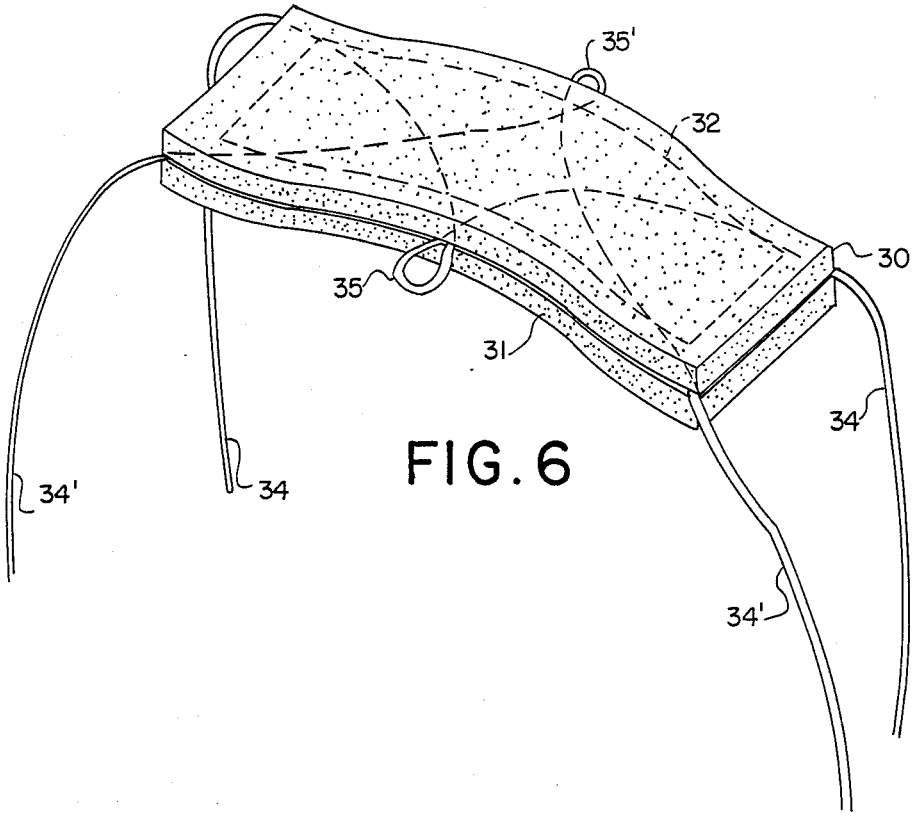
Figure 7:
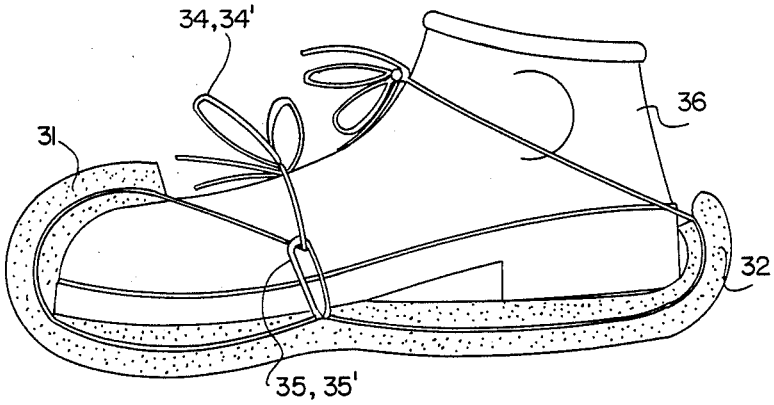

The present invention will be understood better and details of it will emerge from the following description of it and from examples of use, with reference to the Figures of the accompanying drawings in which:

FIG. 1 is a diagrammatic view of an illustrative arrangement of the invention, FIG. 2 is a perspective view of a "snowshoe" using the arrangement of FIG. 1, FIGS. 3*a* and 3*b* show two alternative embodiments of the "snowshoe" of the preceding Figure, FIG. 4 illustrates in detail and on a large scale a component, called a plate, which can be used with the snowshoe, FIG. 5 shows a perspective view of a preferred method of strapping a shoe to the snowshoe, FIG. 6 is a view of a preferred embodiment of a sole of the invention, FIG. 7 is an illustration of the method of using the sole of the preceding Figure, FIG. 8 is another embodiment of a sole similar to that of FIG. 7, and FIG. 9 is an embodiment in the form of an "overboot".

In FIG. 1, a non-slip so-called contact layer 1 is an open-cell foam layer preferably opening onto a relief face 1'; the layer 1 is bonded to a so-called absorption layer 2 of elastic foam which can be of the same type as that of the layer 1 but of a density of between 60 and 70 kg/m$^3$; the foam forming this layer can have closed cells; a cloth sheet 4 is bonded between the two layers; the reference 3 symbolizes a pad which can be flexible or rigid and more or less thick.

In FIG. 2, the above-defined pad is a rigid shell 5 of elongate shape havin a shoe imprint 6 at its center; chambers 14 are made towards the front of the imprint in the wall 13 of the latter; at the bottom of the chambers inserts 12 of axis 11 will make it possible to screw strapping plates 8 (FIGS. 4 and 5). The imprint opens at 15 onto the rear part of the shell and its opening is spanned by a bar 16.

In FIG. 3*a*, the shell is hollow and includes, for example, two plies 5' and 5'' of reinforced polyester.

In FIG. 3*b*, the shell is one-piece and includes a rigid polyurethane foam covered on its upper face with a layer of gel-coat.

In FIG. 4, a plate 8 attachable in the recesses 14 of FIG. 2 has the shape of a quadrilateral with rounded corners and possesses two elongate slots 7, 9 and a through-hole 10 of axis 11 for a screw screwable into the inserts 12 FIG. 2.

In FIG. 5, the shoe is strapped to the shell 5 by means of a continuous strap 20 passing over the instep 21 and then through the opposite (symmetrical) plate 8. The strap 20 then passes over the instep once again at 22, passing once more through the first plate 8, then again over the instep at 23, then a further time through the opposite plate, then behind the heel at 24, then through a safety buckle 28, going behind the heel again at 25, returning over the instep at 26 and finally tensioning the buckle 28 by means of a buckle 27. It will be seen that the position and shape of the plates allow the foot to pivot vertically, as indicated by the arrows 29.

In FIG. 6, a non-slip device comprises two rectangular panels of elastic cellular material 31 and 30 and, between these two panels, a rectangular sheet of gauze 32; it also comprises a pair of ties 34, 34' which can be sewn or bonded beforehand to the gauze sheet or to one of the panels, these ties projecting at each end of the stack of panels and being shaped into loops 35, 35' projecting from the sides of the stack.

In FIG. 7, a shoe 36 is equipped with the device of FIG. 6; the projecting ends of the ties 34, 34' of a first end of the device are threaded into the loops 35, 35' and knotted above the shoe. The shoe is thus provided with an extremely effective non-slip device having a moderate cost price which makes it disposable after use.

In another embodiment (FIG. 8) of a sole of the invention, the means of fastening to a shoe comprises a sheet 37 cut out from a flexible plastic, the cut-out forming a pair of ties 34 at each end of the sheet and a projecting eyelet 38 on each of the sides, the sheet being bonded to a foam panel 31; the sheet of flexible plastic can advantageously be a sheet of polyester.

In another embodiment (FIG. 9), the said fastening means comprises an "overboot" 40 produced from a plastic sheet, the said "overboot" being provided with ties 41 and with eyelets 42 intended for the passages of the ties; it should be noted that the "overboot" could also be produced by thermal bonding at their edges and by cutting out two superposed sheets of flexible plastic; in both cases, the connection between the overboot and the foam panel 31 is made by means of the sole of the overboot.

In the embodiments of FIGS. 6 to 9, the soles could have layers of cellular material of a structure entirely similar to that shown in FIG. 1.

Although a particular embodiment of the invention has been described and illustrated, it must be understood that the scope of the latter is not limited to this embodiment, but extends to any non-slip means having the general characteristics defined above.

I claim:

1. A non-slip device fastenable to a shoe by means of a strap, the said device comprising a pad, a non-slip surface carried by the pad, wherein the non-slip surface is composed of at least one layer of elastic cellular material with open cells and of low density, a second layer of cellular material of high density located between the pad and the open-cell layer, and at least one sheet of stretchable cloth bonded between the two layers, the adhesion of the said sheet being greater to the second layer than to the open cell layer.

2. A non-slip device fastenable to a shoe by means of a strap, the said device comprising a pad, wherein the pad has a rigid shell shape and defines a recess in the form of the imprint of a shoe, a non-slip surface carried by the pad, wherein the non-slip surface is composed of at least one layer of elastic cellular material with open cells and of low density, and a second layer of cellular material of high density located between the pad and the open-cell layer.

3. A device as claimed in claim 2, wherein the pad is fastened to the shoe by means including a pair of plates, each plate having a through-hole and two elongate slots oriented approximately at 130° relative to one another, the hole being contained in the angle of the slots.

4. A device as claimed in claim 3, wherein the location of each plate is defined by a recessed chamber in the pad.

5. A device as claimed in claim 2, wherein the imprint opens into the outside of the pad, and which further comprises a bar functioning as a handle and extending across the imprint opening.

6. A device as claimed in claim 3, wherein the said strap is a continuous strap, the length of which is such that it allows it to pass over the shoe four times from one side of the foot to the other, passing through each of the slots in the plates, and behind the heel twice, and two buckles respectively ensuring the closing of the strap on itself (28) and its guidance (27).

7. A non-slip device fastenable to a shoe by means of a strap, the said device comprising a pad, a non-slip surface carried by the pad, wherein the non-slip surface is composed of at least on layer of elastic cellular material with open cells and of low density, a flexible sheet secured to said layer, and fastening means integral with the said flexible sheet.

8. A device as claimed in claim 7, wherein the said fastening means comprises a plastic overboot having ties and eyelets for receiving the ties.

9. A device as claimed in claim 7, in which the fastening means includes a woven gauze cloth and a plurality of ties and loops projecting from the periphery of said cloth, said device further comprising a second layer overlying said open cell layer with said cloth sandwiched between the two layers.

* * * * *